US006447288B1

(12) United States Patent
De Saro et al.

(10) Patent No.: US 6,447,288 B1
(45) Date of Patent: Sep. 10, 2002

(54) HEAT TREATING APPARATUS

(75) Inventors: Robert De Saro, Annandale, NJ (US); Willis Bateman, Sutton Colfield (GB)

(73) Assignee: Energy Research Company, Staten Island, NY (US)

( * ) Notice: Subject to any disclaimer, the term of this patent is extended or adjusted under 35 U.S.C. 154(b) by 0 days.

(21) Appl. No.: 09/585,014

(22) Filed: Jun. 1, 2000

(51) Int. Cl.[7] ..... F27B 15/02

(52) U.S. Cl. ..... 432/58; 432/14; 432/18; 432/101; 432/176

(58) Field of Search ..... 432/14, 99, 101, 432/152, 120, 176, 71, 17, 190, 199, 18, 55, 58; 110/204, 206; 202/84, 88, 124, 126

(56) References Cited

U.S. PATENT DOCUMENTS 3,733,713 A * 5/1973 Williamson, Jr. ..... 34/57 A
4,002,422 A * 1/1977 Escott ..... 432/99
4,144,654 A * 3/1979 Barr ..... 432/101
4,900,356 A * 2/1990 Hoffman ..... 266/156
5,975,891 A * 11/1999 Hundebol ..... 432/58

* cited by examiner

*Primary Examiner*—Gregory Wilson
(74) *Attorney, Agent, or Firm*—Watov & Kipnes, P.C.

(57) ABSTRACT

Apparatus for heat treating a heat treatable material including a housing having an upper opening for receiving a heat treatable material at a first temperature, a lower opening, and a chamber therebetween for heating the heat treatable material to a second temperature higher than the first temperature as the heat treatable material moves through the chamber from the upper to the lower opening. A gas supply assembly is operatively engaged to the housing at the lower opening, and includes a source of gas, a gas delivery assembly for delivering the gas through a plurality of pathways into the housing in countercurrent flow to movement of the heat treatable material, whereby the heat treatable material passes through the lower opening at the second temperature, and a control assembly for controlling conditions within the chamber to enable the heat treatable material to reach the second temperature and pass through the lower opening at the second temperature as a heated material.

61 Claims, 6 Drawing Sheets

HEAT TREATING APPARATUS

FIELD OF THE INVENTION

The present invention is directed to an apparatus for heat treating a heat treatable material such as metal feedstock or scrap by one or more individual or combined operations of preheating, decoating, and/or melting in an energy efficient and environment-friendly manner.

BACKGROUND OF THE INVENTION

In recent years, recycling of process or post-consumer scrap materials has become increasingly critical in modern times for both environmental and economic reasons. The low-energy cost associated with recycling, combined with growing concerns over solid waste disposal, have contributed to substantial growth in the recycling industry. This trend has been observed in conjunction with many discarded products including beverage cans, metal turnings from manufacturing plants, recyclable household garbage, aluminum foil, discarded glass and bottles, foil packaging materials, steel products, and the like.

Known recycling processes generally involve melting reusable components of waste or scrap material and recasting the same into useful products through the use of gas- or oil-fired reverbatory furnaces or induction electric furnaces. However, these and other similar methods and apparatuses for recycling scrap materials typically require substantial capital expenditure and maintenance expense, generate substantial harmful atmospheric emissions, and require significant energy input. The development of an energy-efficient, environmentally-suitable apparatus for treating metal scrap and other materials is desired to ensure that the recycling industry complies with the energy and environmental performance requirements set forth by tighter regulatory legislation while improving overall profitability of recycling.

The treatment of such materials so that they may be suitable for recycling is problematic because the materials often have coatings of various materials, especially organic materials including protective coatings, lubricants, additives and the like. Successful recycling processes typically mandate that the coatings be removed before the underlying material is recycled. This process often requires separate installations.

A recent apparatus, referred to as a vertical flotation melter ("VFM"), was developed in response to environmental and economic needs and to provide a cleaner and more efficient alternative for melting scrap material. During the melting operation, scrap material is introduced into an upper opening of an upstanding melting chamber where scrap materials of varying sizes, shapes, densities, and surface areas are maintained in a state of suspension by a continuous stream of hot gas flowing upwardly from the lower portion of the chamber. During the suspension phase, heat is transferred from the upwardly flowing gas to the scrap material being treated. When the temperature of the scrap material exceeds its melting point, the solid scrap melts and forms into denser, aerodynamically shaped liquid droplets which fall downwardly through the upwardly directed heated gas. The resulting drops of molten material are collected for subsequent recovery and use.

Such known VFMs suffer from several significant limitations. In particular, the heated gas is directed into the heating chamber through a single port. The upward flow of the gas from a single port is non-uniform which severely restricts a) the overall output rate of recovery, b) the types of material which may be recovered, and the overall thermal and energy efficiency of the heat treating operations. In addition, the lower portion of the melting chamber of known VFMs tend to become blocked from the buildup of the melted scrap material. Such blockages severely degrade the overall operating efficiency and performance of the VFM and may require time consuming shutdowns which add significantly to the cost of operation.

It would therefore be a significant advance in the art of heat treating heat treatable materials and/or the recovery of reusable materials to provide an improved heat treating apparatus with increased recovery yields and reduced emissions in a cost effective and efficient manner. Furthermore, the apparatus may be adapted for use with a range of raw and scrap materials and may be used for various heat treating operations alone or in combination, including preheating, decoating, melting and combinations thereof.

SUMMARY OF THE INVENTION

The present invention is generally directed to a heat treating apparatus for treatment and/or recovery of useful materials such as metals, glass and the like from a variety of sources. The heat treatable materials include those containing vaporizable impurities typically in the form of coatings. The heat treating apparatus is operated and implemented in a manner which provides benefits of improved energy efficiency, product yield, and operating cost. The apparatus is adaptable for use as a preheater, a decoater, a melter and any combination thereof.

In one particular aspect of the present invention, there is provided an apparatus for heat treating a heat treatable material, comprising:

a) a housing comprising an upper opening for receiving a heat treatable material at a first temperature, a lower opening, and a chamber therebetween for heating the heat treatable material to a second temperature higher than the first temperature as the material moves through the chamber from the upper opening to the lower opening;

b) a gas supply assembly operatively engaged to the housing at the lower opening, and comprising a source of heated gas, a gas delivery assembly for delivering the gas through a plurality of pathways into the housing in a manner providing countercurrent flow to movement of the heat treatable material, whereby the heat treatable material passes through the lower opening at said second temperature as a heat treated material; and c) control means for controlling conditions within the chamber to enable the heat treatable material to reach the second temperature and form said heat treated material and pass through the lower opening at the second temperature.

Another aspect of the present invention is directed to a method for heat treating a heat treatable material, comprising the steps of:

a) passing the heat treatable material through a housing from an upper opening at a first temperature through a chamber and out of a lower opening;

b) passing a heated gas through a plurality of pathways into the chamber to generate a flow of the heated gas countercurrent to the direction of the heat treatable material as it passes from the upper opening to the lower opening in a manner such that the heat treatable material leaves the lower opening as a heat-treated material at a second temperature higher than the first temperature; and c) controlling the conditions within the chamber to enable the heat treatable material to attain the second temperature.

BRIEF DESCRIPTION OF THE DRAWINGS

The following drawings in which like reference characters indicate like parts are illustrative of embodiments of the invention and are not to be construed as limiting the invention as encompassed by the claims forming part of the application.

DETAILED DESCRIPTION OF THE INVENTION

The present invention is generally directed to a heat treating apparatus (referred to hereinafter as an "apparatus") constructed to provide in a cost effective and efficient manner, an improved energy efficient heat treating method with increased recovery yields and reduced emissions for use in applications associated with heat treating of various heat treatable materials such as raw and scrap materials. The apparatus is constructed with the advantage of ease of installation, operation and maintenance, and with the high material recovery yield and throughput rate required for industrial processing operations. The apparatus is applicable for use in a variety of heat treating processes including preheating, decoating, melting and combinations thereof.

As used herein the term "preheating" shall mean heat treating the material to a temperature below the melting point thereof so that the material is prepared for another heat treating process, typically operated at a higher temperature than the preheating operation. As used herein the term "decoating" shall mean heat treating the material to a temperature, below the melting point thereof, at which volatile materials which may be on or in the material are vaporized. As used herein the term "melting" shall mean heat treating the material to at least a temperature at which the material will melt.

The apparatus of the present invention may be used to accommodate at least one of preheating, decoating, and melting, performed individually or in combination, by adjusting the conditions in the heating chamber as described hereinafter.

Figure 1:
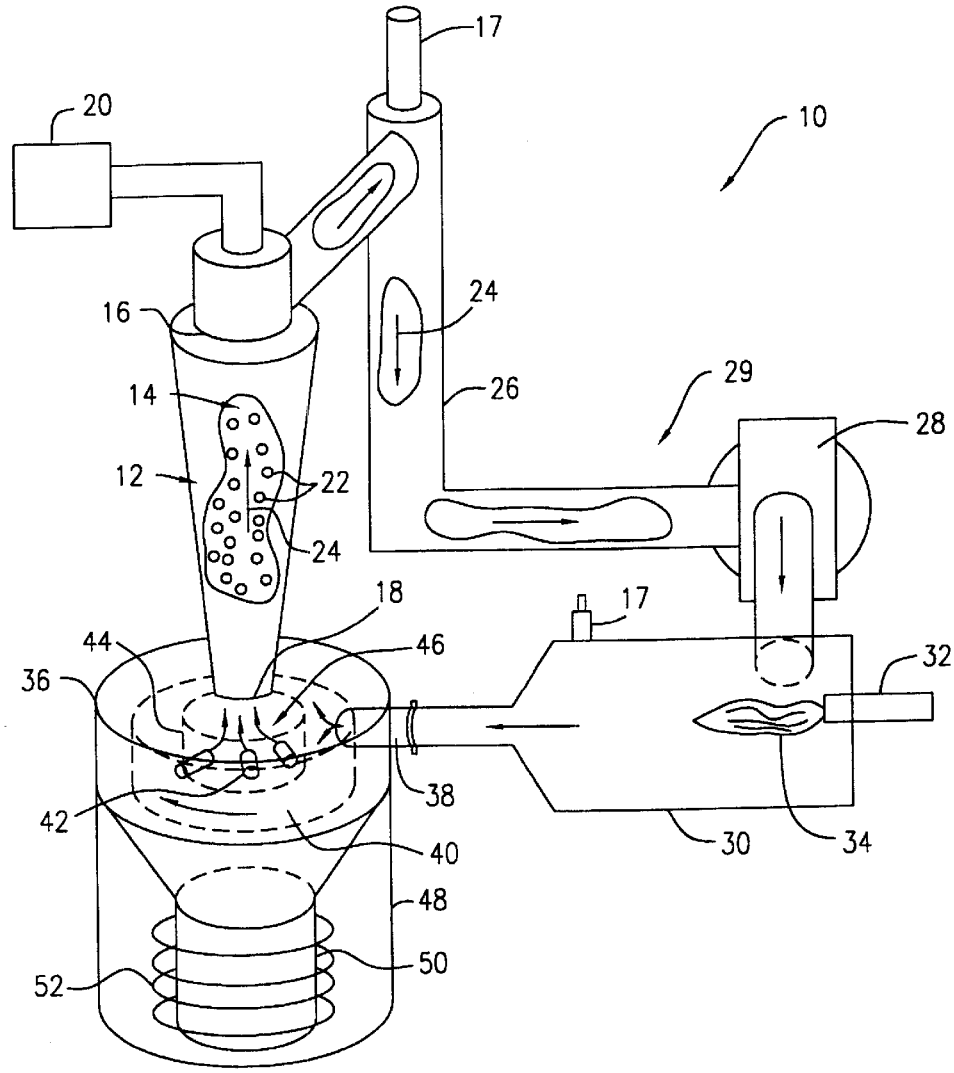
FIG. 1 is a partially cutaway perspective view of an embodiment of an apparatus of the present invention.

With reference to FIG. 1, in one embodiment of the present invention, an apparatus 10 is shown, for heat treating materials including, but not limited to, steel, magnesium, aluminum, glass, copper, lead, titanium, zinc, hastalloy and tungsten. The term "heat treating" as used hereinafter refers generally to discrete operations involving preheating, decoating, and/or melting of heat treatable materials for recovery which may then be recast into useful products. The particular operation performed by the apparatus 10 will depend primarily on the conditions within the heating chamber including, but not limited to, the operating temperature and velocity of the gas flow therein.

As shown in FIG. 1, the apparatus 10 includes a heating vessel 12 formed of and/or lined with a refractory or heat resistant material such as a metal, for defining an upright chamber 14, which may have a downwardly extending taper (i.e. the chamber may be in the shape of a cone). The chamber 14 includes opposing upper and lower openings 16 and 18. The heat treating process performed by the apparatus 10 occurs within the chamber 14 as will be described.

The apparatus 10 further includes a heated gas delivery assembly 29 for delivering a heated gas 24 to the chamber 14 for heating the heat treatable material. The heated gas delivery assembly 29 includes a plenum 36 connected to the bottom of the chamber 14, a recirculation duct 26 for recirculating the heated gas 24 through the chamber 14, a heating furnace 30 with an exhaust outlet 17 for expelling combustion by-products, and a recirculation fan or blower 28 for inducing and controlling the flow of the heated gas 24 throughout the apparatus 10. The heated gas 24 is continuously induced upwardly through the plenum 36 into the chamber 14 by the blower 28 to an extent necessary to transfer heat to the concurrently flowing heat treatable material 22.

Figure 2:
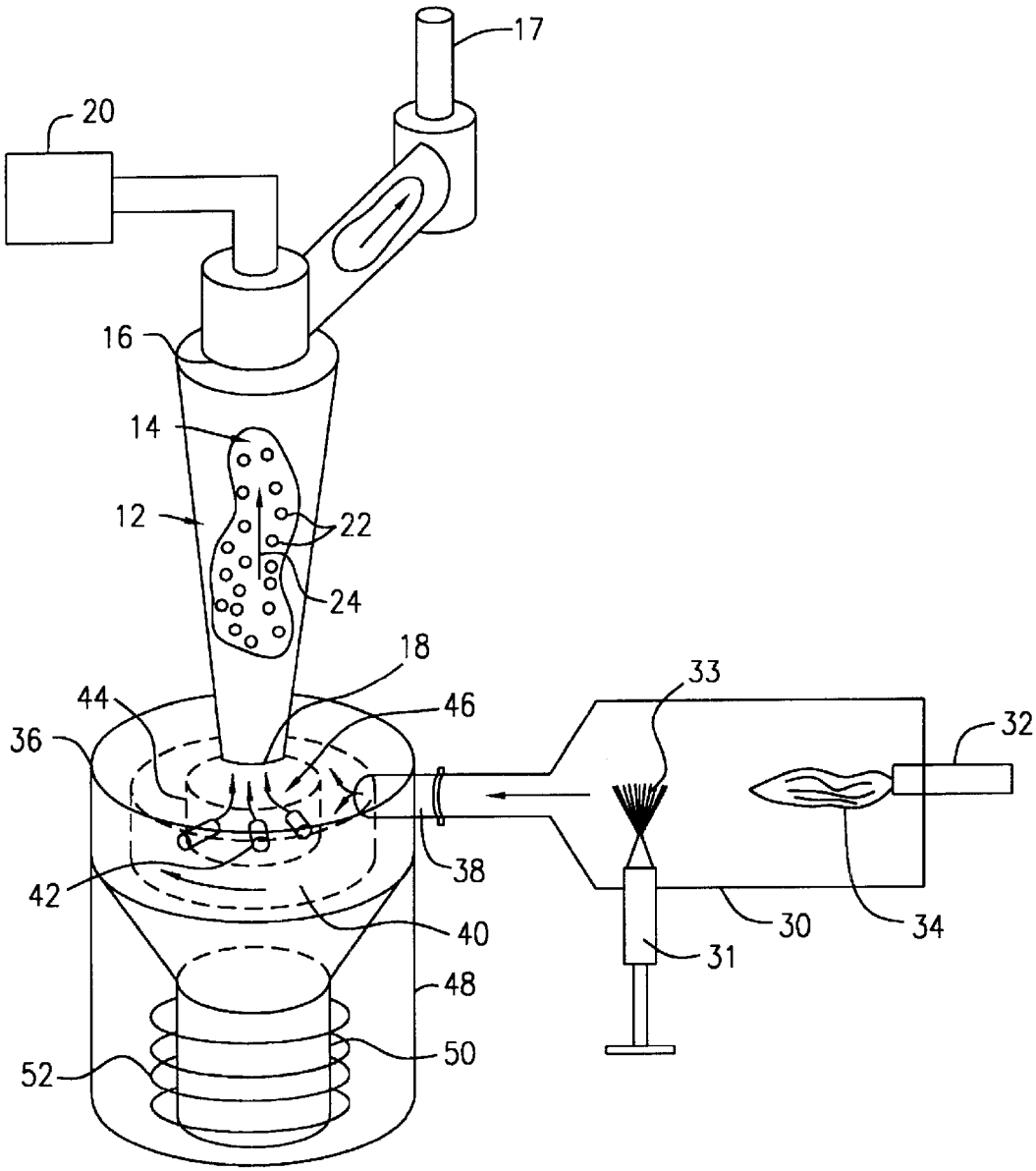
FIG. 2 is a partially cutaway perspective view of another embodiment of an apparatus of the present invention.

Alternatively as shown in FIG. 2, a heated gas flow may be generated through the use of a vaporizable fluid 33 from a vaporizable fluid feed assembly 31. A vaporizable fluid 33 such as water is injected continuously through the assembly 31 into the heating furnace 30 or some other heat source which vaporizes the fluid 33 to produce a heated gas 24. The subsequent increase in gas pressure drives the heated gas 24 through the chamber 14 in a manner sufficient to transfer the heat to the heat treatable material 22. The heated gas 24 upon passage through the chamber 14 exits the apparatus through the exhaust outlet 17. The fluid feed assembly 31 may also be used as a gas temperature regulating system by controlling the amount of the fluid 33 injected into the heating furnace 30.

Referring again to FIG. 1, during general operation, the material 22 is introduced into the chamber 14 through the upper opening 16 wherein a heat treatable material of varying size, shape, density, and/or surface area is suspended by the heated gas 24 flowing upwardly from the lower opening of the chamber 14. The upwardly flowing heated gas 24 inhibits the downward flow of the material for a time (residence time) sufficient to transfer heat from the heated gas 24 to the material 22. Afterward, the resulting heated material 22 is collected for subsequent recovery.

The recirculation duct 26 extends at one end from the upper opening 16 of the chamber 14 for reclaiming at least a portion of the heated gas 24 exiting from the chamber 14 to an opposed end leading to the heating furnace 30. A gas exhaust outlet 17 may be provided near the upper opening 16 (for preheating and melting operations only) or after the heating furnace 30 for releasing any combustion by-products generated within the apparatus 10. The blower 28 serves to generate and regulate the movement and velocity of the heated gas 24 through the recirculation duct 26, the heating furnace 30, the plenum 36 and the chamber 14. The velocity of the heated gas 24 may be adjusted within the chamber 14 preferably from about 1 to 900 feet per second depending on the size, density, and type of material 22 being processed therein.

The heating furnace 30 is positioned between the recirculation duct 26 and the plenum 36 and downstream from the blower 28. The heating furnace 30 provides additional heat as may be necessary to maintain the temperature of the heated gas 24 within the chamber 14 to a temperature necessary to carry out the heat treating operation. The heating furnace 30 includes a burner 32 for supplying heat to the passing heated gas 24. It will be understood that the apparatus 10 may be further adapted to utilize alternative heat sources such as heat supplied by waste or exhaust gases from independent processes, conventional furnaces, auxiliary heat sources, and the like.

In an important aspect of the present invention, the plenum 36 enables the generation of a uniform, upwardly flowing gas stream into the chamber 14. The plenum 36 is mounted underneath the lower opening 18 of the chamber 14. The heated gas 24 heated by the heating furnace 30 enters the plenum 36 through an inlet port 38. The plenum 36 is configured to at least substantially evenly distribute the heated gas 24 in a manner providing a uniform cross sectional flow into the chamber 14 as will be described in detail hereinafter. Uniform flow of the heated gas 24 is at least partially the result of supplying the heated gas 24 from multiple positions about the plenum 36. The flow of the heated gas 24 stabilizes the suspended material 22 within the chamber 14 to enable the material 22 to be uniformly heat treated to a desirable temperature. By improving the flow of the gas 24 through the chamber 14, and by increasing the gas velocity, a significantly higher heat transfer is obtained. As a result, the apparatus 10 requires lower temperatures within the chamber 14 than conventional systems. Higher heat transfer enables more of the available heat to be transferred to the material 22 which likewise reduces the time the material 22 must stay in the chamber 14. The lower temperature also increases the recovery yield rate by minimizing the opportunity for destructive oxidative reactions in the material 22 and for dross formation during melting operations.

As the heated gas 24 moves upwardly within the chamber 14, the velocity of the upwardly traveling heated gas 24 generally decreases. This is especially apparent when the chamber 14 has a downwardly tapered shape. Accordingly, the fall rate of the material 22 gradually decreases as the material 22 moves downwardly within the chamber 14.

A feed assembly 20 for delivering the heat treatable material to the heat treating apparatus of the present invention is best shown in FIG. 1. The feed assembly 20 provides access to the upper opening 16 of the chamber 14 and delivers the heat treatable material 22 thereto. The feed assembly 20 includes any conventional means (e.g. conveyor system) for delivering the heat treatable material 22 continuously or batchwise to the chamber 14.

As the material 22, supplied from the feed assembly 20, enters the chamber 14 and falls downwardly therein, the upward flow of the heated gas 24 imposes a drag force on the falling material 22. An equilibrium state is achieved when the weight of the individual pieces of material 22 equals the drag force imposed thereon thereby suspending the material 22 at some location within the chamber 14. The location and duration of this suspension phase will depend, in part, on the size, weight and aerodynamic characteristics of the material 22. In particular, lighter weight pieces of material 22 are typically suspended closer to the upper opening 16, and heavier pieces of material 22 are typically suspended closer to the lower opening 18 of the chamber 14. The shape and configuration of the chamber 14 further provides a stable aerodynamic environment for the suspended material 22. As described above, the flow velocity of the heated gas 24 is greater near the lower opening 18 than at the upper opening 16. If an individual piece of material 22 is jolted upwardly within the chamber 14, the material 22 is displaced to a region of lower flow velocity. The lower flow velocity generates reduced drag force whereby the effect of gravity returns the material 22 to its original position. Conversely, if an individual piece of material 22 is jolted downwardly into a region of higher flow velocity, the resulting increase in drag force lifts the material 22 back to its original position.

As the individual pieces of the material 22 are suspended by the heated gas 24, rapid convective heat transfer occurs and enables the suspended material 22 to reach a desired temperature in a short residence time. The high flow velocities provide a significantly higher heat transfer than that of conventional reverbatory furnaces which rely on radiant heating. As a result of the heat transfer, the apparatus 10 heat treats the material 22 at a lower gas temperature, shorter residence time, and lower rate of energy consumption compared to conventional furnaces. The lower gas temperatures and shorter residence times in combination, improve the overall recovery yield rate by minimizing the opportunity for the material 22 to undergo destructive oxidation reactions and dross formation during the heat treating operation. Furthermore, the lower gas temperature requirements and energy efficiency permits the apparatus 10 to utilize heated waste gases from other sources for heat treating the material 22 and therefore provides the opportunity for even greater reduction in energy consumption.

The composition of the heated gas 24 is preferably limited to an amount of oxygen which prevents or at least substantially minimizes combustion or oxidation in the chamber 14. For most operations especially decoating, the oxygen content of the heated gas 24 is within a range of up to 12% by volume, and more preferably from about 4% to 12% by volume. For melting operations, the oxygen content may be as low as 2% or lower. In many cases, an oxygen content of significantly greater than 12% raises the risk of undesirable oxidative reactions. Control of the oxygen content reduces the incidence of oxidative reactions during heat treating for an improved recovery yield.

The apparatus 10 of the present invention may be used for preheating, decoating and/or melting a wide range of heat treatable materials. The structure and heat treating conditions within the chamber 14 may be regulated according to the type of materials which are to be heat treated and the heat treatment which is to be performed. The structure of the chamber such as the length, angle of taper (chamber angle) and the like, as well as heat treating conditions including the gas flow velocity and gas temperature, are important variables in heat treating the material for an efficient and effective operation.

The critical dimensions of the chamber 14 are the chamber angle, the size (e.g., diameter) of the upper and lower openings 16 and 18, respectively, and the chamber length. The "chamber angle" is defined herein as the angle formed by the interior surface of the chamber and the longitudinal axis. The "chamber length" is defined as the length of the chamber measured along the longitudinal axis between the upper and lower openings 16 and 18.

The chamber dimensions are selected according to a number of factors, including, but not limited to, the throughput rate of the heat treatable material, the type of operation (e.g., decoating, melting, etc.), the material density, the material size distribution, the desired thermal efficiency, and the desired gas temperature at the top and bottom of the chamber.

More specifically, higher material throughput rate generally require larger chamber upper and lower opening diameters as well as higher chamber lengths. As the operational temperature increases (e.g. changing the heat treating operation from decoating to melting), an increase in upper and lower opening diameters and chamber length will be generally required.

As the density of the heat treatable material increases it is generally desirable to reduce the chamber dimensions. On the other hand, as the size distribution of the heat treatable material increases, it is generally desirable to increase the chamber length. Improved thermal efficiency typically requires an increase in the upper and lower opening diameters as well as chamber length. In addition, as the desired temperature of the gas at both the upper and lower openings increase, it is generally desirable to reduce the chamber length and diameters.

From the foregoing, it can be observed that the structural parameters of the chamber are implicated in controlling the operational parameters of the heat treating system of the present invention. It will be understood that a commercially operable apparatus in accordance with the present invention desirably heat treats heat treatable material at significant throughput rates. Accordingly, the structural dimensions for the apparatus are chosen with the understanding that they may not be readily changed because of overall size of the apparatus. In this event, the operating parameters may be adjusted to accommodate the fixed dimensions of heat treatable materials having size and density characteristics.

Assuming the length of the chamber remains constant, as the chamber angle increases, the cross sectional area of the chamber from the lower to the upper opening per unit length will increase. As a result, the velocity of the gas moving upwardly through the chamber will decrease at a greater rate. For most applications, the chamber angle can range from 0° (the chamber is in the form of a cylinder) up to an angle that will still enable the heat treatable material to be suspended for a time sufficient to perform the heat treating operation and which does not allow gas flow separation from the walls in which areas of little or no gas flow are present at the wall surface (i.e. non-uniform gas flow). The chamber angle is preferably selected from about 0° to 10°, more preferably from about 3° to 7°, and most preferably at about 5.5°.

For a given gas flow rate and temperature, a correlation exists between the size of the chamber 14, i.e. chamber length, upper and lower opening sizes, and the operating characteristics of the apparatus 10. The variation in gas flow velocities is directly related to the chamber length (for angles greater than zero degrees). The longer the chamber 14, the wider the variation in gas flow velocities therein. Accordingly, a longer chamber 14 can better accommodate a material having a large size distribution than a shorter chamber 14. While the chamber lengths may vary for many applications, a typical commercial apparatus of the present invention will have a chamber length in the range of from about 5 to 60 feet. The upper and lower openings 16 and 18 have respective diameters typically in the range of about 1 feet to 15 feet. The diameter of the upper opening 16 will typically be larger than the diameter of the lower opening 18.

Generally for decoating a lower gas temperature is required resulting in a shorter chamber, and for melting a higher gas temperature is required resulting in a taller chamber. As the density of the material increases, a corresponding decrease in chamber length may be desired for effective and efficient operation. An increase in chamber length generally induces a higher thermal efficiency and larger throughput of heat treatable material.

For a given chamber structure, the gas flow rate and gas temperature may be controlled or regulated to accommodate various types of heat treatable materials. A typical apparatus of the present invention may be designed to vary the gas velocity by a factor of about 5 to 10 proceeding from the lower to the upper openings 18 and 16, respectively. For example, the gas flow velocity may be 75 feet per second (fps) at the lower opening and 10 fps at the upper opening for a given gas flow rate. The range of flow velocities may be shifted by varying the output of the blower. If the output of the blower is doubled, for example, the flow velocity in the above-mentioned example, changes to 150 fps and 20 fps, respectively. An increase in gas flow velocity enables heavier or larger materials to be suspended in the chamber for heat treating. Conversely, the output of the blower may be reduced to accommodate smaller or lighter materials.

Preheating requires that the apparatus 10 be operated under conditions that raise the temperature of the material 22, but does not otherwise change its physical state (e.g., melting) or chemical composition (e.g. removal of organic substances). Typically preheated material will be sent for further processing, such as to a melting furnace, for example.

Decoating requires that the apparatus 10 be operated under conditions that provide a temperature sufficient to vaporize undesirable organic substances but less than the melting temperature. If melting is desired then the apparatus 10 is operated at a temperature sufficiently high to melt the material 22 so that it may be collected in its melted state. Decoating and melting may be performed in a single operation so that untreated material 22 containing undesirable organic substances may be collected as an organic substance-free melt.

During a melting operation, the heated gas 24 is heated by the heating furnace 30 to a temperature exceeding the melting point of the material 22. As the heated gas 24 imparts heat to the suspended material 22 within the chamber 14, the material 22 is heated to at or above its melting point. As the material 22 melts, it forms individual droplets which take on a desirable aerodynamic and compact shape, thus reducing the drag force on the material 22. Accordingly, the melted material 22 overcomes the countercurrent force of the upwardly flowing heated gas 24 and thereby slips downwardly through the heated gas 24 and out of the chamber 14 through the lower opening 18. In order to reduce buildup of the material 22 on the interior surface of the chamber 22, it may be desirable to add a flux composition to the material 22 prior to introduction into the chamber 14. The composition of the flux material will vary depending on the material 22 being heat treated. Such flux compositions are optional and well known to those of ordinary skill in the art.

Figure 3:
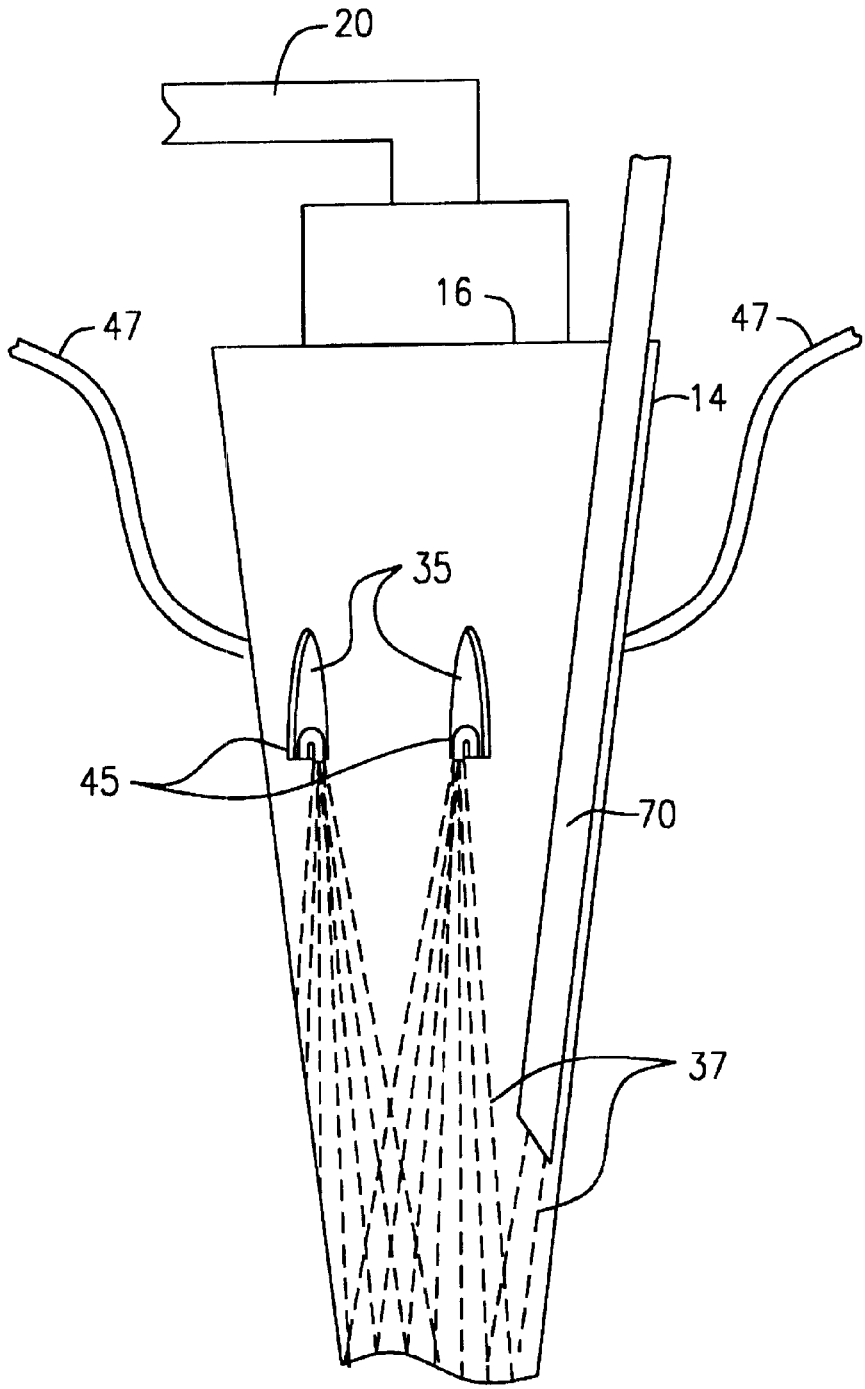
FIG. 3 is a partial longitudinal cross sectional view of a heat treating chamber including a cleaning material delivery assembly.

In addition or as an alternative to the use of flux compositions, the interior of the chamber may be cleaned through the use of a cleaning material delivery assembly. Referring to FIG. 3, a cleaning material delivery assembly 35 may be used to maintain the interior surface and the lower opening of the chamber 14 substantially free of material 22 buildup. The delivery assembly 35 includes at least one conduit 47 for delivering and injecting a cleaning material 37 which may be in the form of a gas, a liquid and/or a solid, through a nozzle 45 or similar device onto the interior surface of the chamber 14. Preferably, the delivery assembly 35 is operable in-situ as the apparatus 10 heat treats the material 22. The cleaning material 37 is preferably composed of an inert material which does not physically or chemically alter the material 22 and which can be separated from the material 22 during recovery. Examples of inert cleaning materials include sand, bicarbonate, and the like. Also, a variety of different types of mechanical scraper can also be used to removed any buildup on the walls.

During a melting operation, it is desirable to collect and maintain the heat treated molten material in a vessel until it may be further processed. Referring again to FIG. 1, a holding furnace 48 is used to collect the heat treated molten metal. The holding furnace 48 may be optionally connected to the lower opening 18 of the chamber 14 with a heated tank 50 located therein for collecting the melted material 22. During operation, the holding furnace 48 is maintained at or above the melting temperature of the material 22 using an electrical heater 52 or other suitable heat source. Since the furnace 48 is only required for holding an already melted material 22, and does not serve a substantial role in the actual melt process, the amount of heat required from the furnace 48 is less than that typically required to melt the material 22, especially if efficient insulation is utilized. The heated material 22 may also be fed into a conventional furnace.

The apparatus 10 may be adapted to heat treat a heat treatable material 22 containing organic substances, typically in the form of a coating, which would otherwise require removal prior to their introduction into a conventional melting furnaces. The apparatus 10 is configured to provide the option of decoating and melting the material 22 in a single step process. Material 22 which may contain organic substances such as oil, lacquer, paint, rubber, plastics and like material of this type, may be fed directly into the chamber 14 without prior treatment or preparation.

The temperature of the heated gas 24 is preferably adjusted above the melting point of the material 22. The high temperature and flow velocity of the heated gas 24 rapidly strip and vaporize the organic substances from the material 22. To prevent the organic substance from prematurely oxidizing on the material 22, the oxygen content of the heated gas 24 is preferably restricted to a range of from about 4% to 12% by volume. The vaporized organic substances are rapidly carried by the heated gas 24 into the heating furnace 30 where they are at least substantially combusted by the burner 32 and expelled through the exhaust outlet 17. When the material 22 is initially suspended in the heated gas 24, melting is momentarily delayed because the organic substances act as a heat sink to the heated gas 24. Once the substances are vaporized and removed from the apparatus 10, the heating of the material 22 proceeds until melting occurs and the melted material 22 drops out of the chamber 14 in the same manner as described above.

Figure 4:
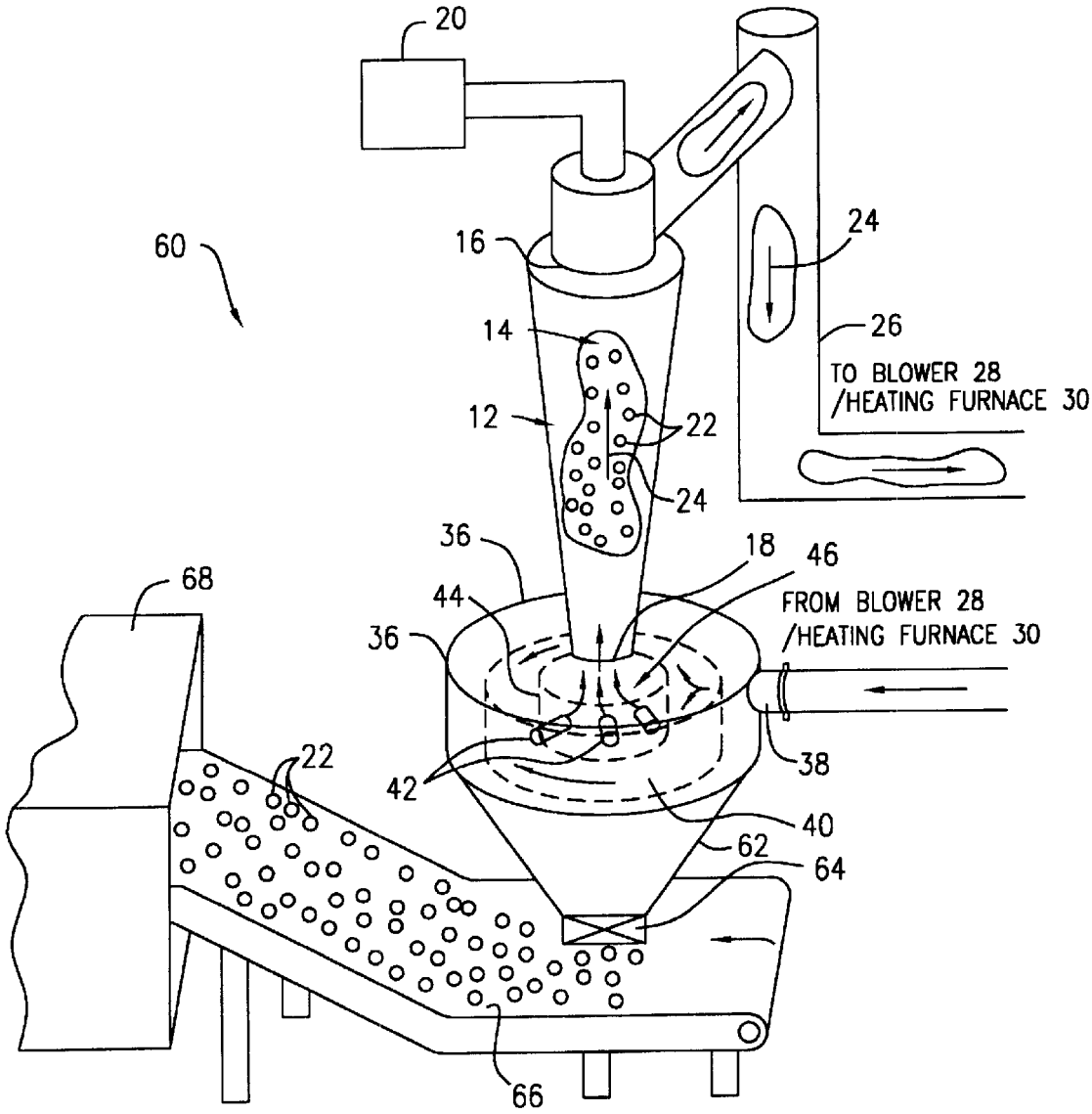
FIG. 4 is a partially cutaway perspective view of a further embodiment of an apparatus of the present invention.

The present invention is readily adapted for preheating and/or decoating operations. Referring to FIG. 4, an apparatus 60 is shown for an alternative embodiment of the invention which may be utilized for preheating and/or decoating operations. Preheating and decoating operations are generally performed to prepare the material 22 for further heat treatment, i.e., melting. The resulting preheated and/or decoated material 22 remains at least substantially in solid form. Therefore, it is preferable for the heat treated material to pass from the apparatus 60 directly to a subsequent processing apparatus or a melting furnace, for example, so that the entire processing system is run continuously resulting in economies of handling, space, and energy consumption.

The apparatus 60 typically includes the same or similar structural components as the apparatus 10 described above. The apparatus 60 further includes a basin 62 mounted under the chamber 14 for collecting and dispensing the material 22 heat treated in the chamber 14. A valve assembly 64, preferably a rotary air lock valve assembly or a dump valve arrangement, is attached at the lower end of the basin 62. The valve assembly 64 dispenses the material 22 from the basin 62 in a controlled manner while maintaining a closed essentially gas-tight condition within the apparatus 60. The material 22 is passed onto a conveyor belt assembly 66 located below the basin 62. The conveyor belt assembly 66 transports the material from the basin 62 directly to a processing apparatus 68 which may be a melting furnace or some other industrial processing apparatus for further processing. Alternatively, the basin 62 may be connected to the processing apparatus 68 for direct feeding of the decoated material 22 therefrom.

During the decoating operation, the apparatus 60 operates in substantially the same manner as during the melting operation except for a reduction in temperature and gas flow rate of the heated gas 24 from the heating furnace 30. The high flow velocity of the heated gas 24 and the associated high heat transfer efficiency, makes the apparatus 60 suitable for decoating. Decoating is the process of stripping or vaporizing any organic substances such as paper, glue, plastics, lacquers, paints, oils and the like which are present on a material 22 for processing. Such substances often degrade the quality of the material 22 and induce unwanted oxidative reactions in conventional melting furnaces.

In the decoating operation, the heated gas 24 is preferably heated to a temperature exceeding the vaporization point of the organic substances but below the melting point of the material 22. The oxygen content of the heated gas 24 is kept low, preferably in the range of from about 4% to 12% by volume. The low oxygen content ensures that the material 22 will not combust or oxidize in the chamber 14. However, the oxygen content of the heated gas 24 is sufficient to enable oxidization of any residual carbon coating on the material 22 into at least substantially harmless by-products.

In the chamber 14, the high velocity heated gas 24 initially strips the organic substances from the material 22 and the heat vaporizes any remaining residues. Once stripped and vaporized, the vaporized organic substances are removed from the chamber 14 and combusted by the burner 32 in the heating furnace 30 or a suitable heat source such as the processing apparatus 68, i.e., a conventional reverbatory furnace. The resulting harmless by-products (e.g., carbon dioxide and water vapor) are released through the exhaust outlet 17. The combustion of the organic substances advantageously heats the heated gas 24, thus further reducing the total energy input into the apparatus 60. The decoated material 22 is then delivered to the processing apparatus 68 for further processing.

Since the decoated material 22 remains a solid in the chamber 14, the material 22 tends to stay suspended in the chamber 14 during the heat treating process. For continuous decoating, discharging and recharging the chamber 14 with additional heat treatable material may be performed as follows. The material 22 is sent into the chamber 14 continuously until the heated gas 24 is unable to sustain portions of the material load which then drops out through the lower opening 18. Eventually, the apparatus 60 reaches a steady state where the amount of material 22 entering the chamber 14 equals the amount of material 22 exiting therefrom.

A batchwise process which requires periodic interruption of the flow of the heated gas 24 through the chamber 14 may be performed as follows. Initially, the chamber 14 is filled with the material 22 while the heated gas 24 is permitted to suspend and decoat the material 22 for a desired time. When the decoating operation is completed, the flow of the heated gas 24 is terminated, and all of the material 22 remaining within the chamber 14 drops out through the lower opening 18. This method is repeated for each subsequent batch of material 22 for decoating.

The capacity to discharge and recharge simply by interrupting the flow of the heated gas 24 provides a practical and a safety advantage over conventional decoaters, i.e. rotating decoating kilns. Conventional decoaters typically require at least 20 minutes to completely discharge the material which is undergoing heat treating. Thus, if a different material is desired for heat treating or an emergency situation arises in conventional decoaters, it takes at least twenty minutes to discharge the heat treatable material and commence a service operation. However, in the apparatus of the present invention, the gas flow employed for heat treating a material is simply terminated and the current batch of material is rapidly discharged from the chamber 14. The gas flow is then resumed and another batch of the same or different material may be charged with little or no delay.

During the preheating operation, the material 22 is heated in essentially the same manner as in decoating described above. The heated gas 24 is heated to a desired elevated temperature below the melting point of the material 22 before being discharged from the chamber 14 for recovery and subsequent delivery to the processing apparatus 68. The discharge and recharge of the chamber 14 is executed in the same manner as described above. The preheating operation provides benefits by reducing energy use and emissions of the processing apparatus 68, while increasing the throughput and overall productivity.

Figure 5:
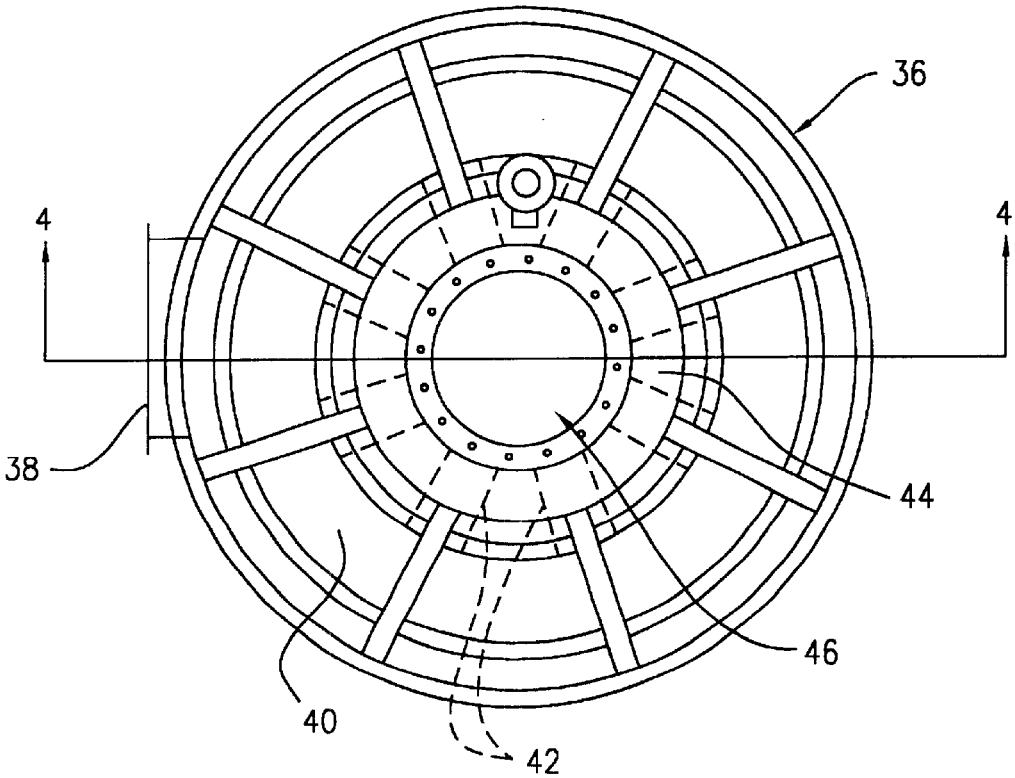
FIG. 5 is a top plan view of a plenum of the apparatus shown in FIG. 1.
Figure 6:
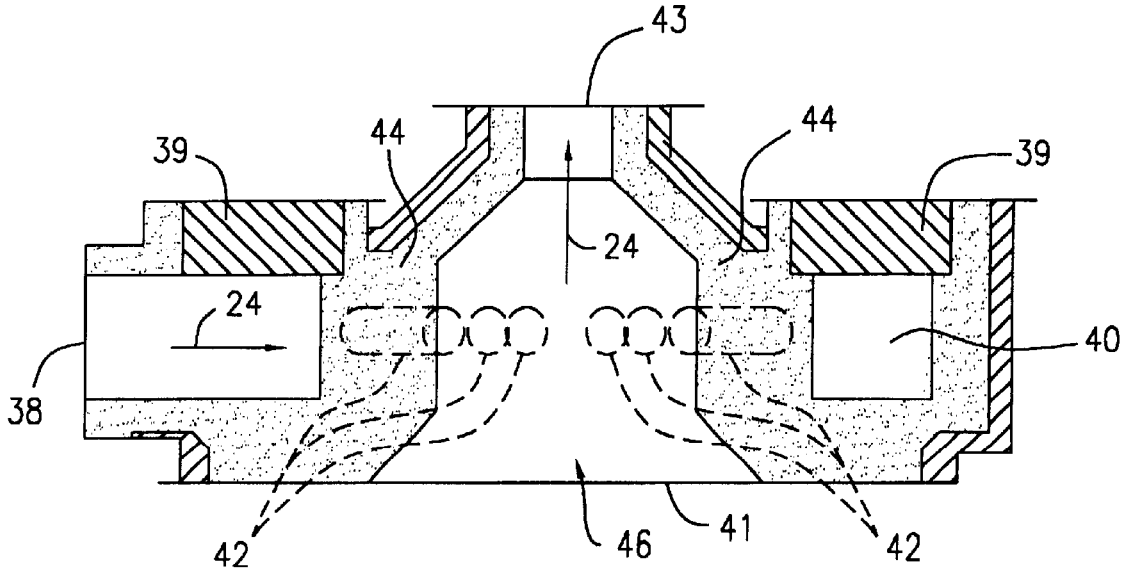
FIG. 6 is a cross sectional view of the plenum along the line 4—4 as shown in FIG. 5.

An important aspect of the present invention is the delivery of the heated gas 24 through multiple pathways which provides for uniform flow of the heated gas 24, improved thermal efficiency and helps to reduce clogging of the interior surface and the lower opening 18 of the chamber 14. Referring to FIGS. 5 and 6 and first to FIG. 5, a top plan view of the plenum 36 is shown with the interior visible. The plenum 36 includes an annular cavity 40 which extends around a centrally located throughhole 46, and a partition 44 therebetween. The throughhole 46 connects the chamber 14 with the holding furnace 48 (see FIG. 1) or the basin 62 (see FIG. 2) to enable the heat treated material 22 to pass therethrough. An inlet port 38 is provided for delivering the heated gas 24 into the annular cavity 40. A plurality of spaced apart pathways 42 are provided around the throughhole 46. The pathways 42 each connect the annular cavity 40 with the throughhole 46 to form a gas flow passage from the inlet port 38 to the throughhole 46. In a preferred form of the invention, the pathways 42 are arranged radially in an equally spaced-apart configuration. The number of pathways and the diameter of each pathway will be selected to provide a uniform gas flow upwardly through the chamber 14 and will at least in part depend on the gas flow rate.

Referring to FIG. 6, a cross sectional view of the plenum 36 is shown. The function of the plenum 36 is to distribute the flow of the heated gas 24 into the chamber 14, in a manner which induces uniform flow of the gas at a desirable velocity within the chamber 14. A uniform gas flow reduces the tendency of the heat treatable material 22 to block the chamber by reducing the amount of the material 22 which may collect along the interior surface of the chamber 14, thus maintaining the chamber 14 in a condition for sustaining a heat treating operation for longer periods of time.

During operation, the heated gas 24 enters the inlet port 38 from the heating furnace 30. The heated gas 24 flows into the annular cavity 40 which is enclosed at the top by an annular cap 39. The plurality of pathways 42 distributes the heated gas 24 evenly from all sides of the throughhole 46. The throughhole 46 narrows from a bottom end 41 to a top end 43. From the pathways 42, the flow of the heated gas 24 proceeds up the throughhole 46 into the chamber 14. Since the heated gas 24 is fed equally from all sides of the throughhole, a uniform flow of the heated gas 24 is established which extends upwardly into the chamber 14. The uniform flow of the heated gas 24 minimizes contact of the melted material 22 with the sides of the chamber 14 and throughhole 46 which would otherwise result in blocking or plugging of the chamber 14.

With reference to FIGS. 1 through 6, the overall operation of the apparatus of the present invention will now be described. The upward flow of heated gas 24 in the chamber 14 is initiated by powering the blower 28. The heating furnace 30 is activated to heat the heated gas 24 to a desired temperature depending on the desired heat treating operation, i.e., melting, melting/decoating, decoating, and/or preheating. The heated gas 24 exits the heating furnace 30 and enters the plenum 36 through the inlet port 38. The heated gas 24 is desirably distributed evenly through each pathway 42 into the throughhole 46 of the plenum 36 to assist in providing a uniform gas flow upwardly through the chamber 14. Upon passing through the chamber 14, the heated gas 24 is reclaimed by the recirculating duct 26 for recycling the heated gas 24. As the heated gas flow upwardly through the chamber 14, the material 22 is fed into the chamber 14 through the upper opening 16 by the feed assembly 20.

Since the velocity of the heated gas 24 progressively decreases from the lower opening 18 to the upper opening 16, the material 22 is suspended by the upward flow of the heated gas 24 and segregated according to size, weight, and aerodynamic characteristics of each individual piece of material 22 for efficient heat treating.

During melting and melting/decoating operations, the temperature of the heated gas 24 is elevated above the melting point of the material 22. As the suspended material 22 melts into a more compact liquid droplet form, the melted material 22 drops downwardly through the plenum throughhole 46 into the heated tank 50 of the holding furnace 48 (see FIG. 1) for subsequent recovery.

During the decoating operation, the temperature of the heated gas 24 is elevated above the vaporization point of the organic substances which may be present on the heat treatable material 22, but below the melting point. During the preheating operation, the temperature of the heated gas 24 is elevated to a desired temperature below the melting point of the material 22. In both operations, the heat treated material 22 remains in solid form. Accordingly, the material 22 remains suspended by the upwardly flowing heated gas 24 during heat treating. The material 22 can be added to the apparatus 10, 60 continuously or batchwise. The heat treated material 22 is then released into and collected in the basin 62 and 15 discharged through the valve assembly 64 onto an optional conveyor belt assembly 66. The conveyor belt assembly 66 delivers the discharged material 22 to the subsequent processing apparatus 68 for further processing.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

EXAMPLE 1

A pilot-scale apparatus of the type shown in FIG. 1, including two burners, each of which supplied a maximum total thermal rating of about 4 MMBtu/hour, was built for testing. One of the burners fired into the lower portion of the heating chamber and the other fired at the lowest thermal setting into the holding furnace for maintaining the temperature therein at or about the melt temperature of the heat treatable material. Aluminum used beverage cans or "scrap metal" were obtained from Wabash's (formerly Roth Bros.) East Syracuse plant which have been previously decoated and shredded into three to four square inch pieces. The scrap metal was manually loaded into a bucket elevator where the scrap metal was deposited into a double dump valve assembly located at the top of the chamber for supplying the untreated scrap metal.

The furnace was first heated without scrap metal to achieve an operating temperature of about 1,600° F. The scrap metal was introduced into the chamber at a desired throughput rate (shown in Table 1) until the gas temperature stabilized at a constant temperature which took approximately 2–3 hours of operation. For energy use data collection, the firing rates of both burners were recorded and summed to account for the total energy consumption. To calculate the specific energy use, the total energy consumption was divided by the total throughput of scrap metal. For determining the metal yield, the molten top layer or dross was skimmed off and weighed. The amount of the dross collected was then compared to the total scrap metal throughput for determining the metal yield. It should be noted that ideally the yield should be calculated after the furnace had been operating for several weeks. Accordingly, the yields provided herein are relatively conservative.

The graph shown in Table 1 provides data comparing energy use versus throughput.

TABLE 1

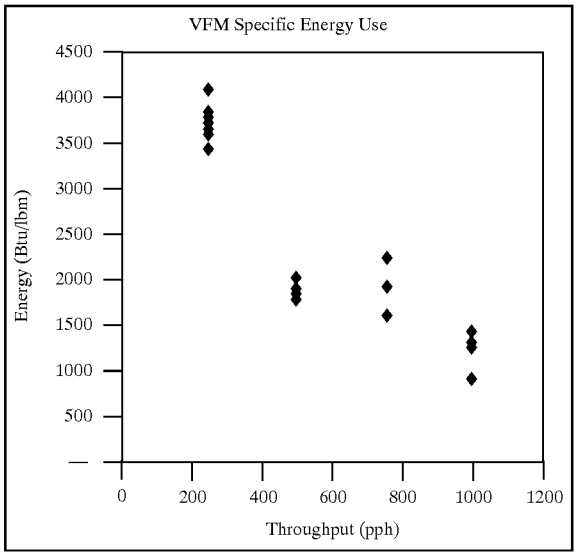

It was determined that as the throughput of the apparatus increased, the corresponding specific energy use decreased. At 1,000 pounds per hour (pph) throughput, the amount of energy varied between 849 Btu/lbm and 1,375 Btu/lbm. The pilot-scale furnace was supplied with the Wabash aluminum scrap metal at a maximum rate of 1,000 pph. However, with better shredded scrap metal, it is possible to approach 2,000 pph, resulting in an improved conservation of energy. Typical recovery of the heat treated material was between 97 and 97.7%.

The following Table 2 lists the operational parameters of the heat treating apparatus described above for various materials. For each material, the associated physical properties including theoretical and effective density, dimensions, melting temperature and the like are listed. The effective density is determined by calculating the material volume using its characteristic dimension and dividing by the weight of the material. In instances in which the material is folded, crumpled, or irregular in form such as used beverage cans and turnings, the effective density would be less than the theoretical density. Depending on whether the apparatus is used for decoating/preheating or melting, the corresponding operating gas temperatures, gas densities and gas flow velocities are listed for each material.

TABLE 2

| | | | | | DECOATING/PREHEATING | | | MELTING | | |
|---|---|---|---|---|---|---|---|---|---|---|
| Materials | Theoretical Density (lbm/ft$^3$) | Effective Density (lbm/ft$^3$) | Approx Melting Temp. (F.) | Charac. Dimension (in) | Gas Temp. (F.) | Gas Density (lbm/ft$^3$) | Terminal Velocity (fps) | Gas Temp. (F.) | Gas Density (lbm/ft$^3$) | Terminal Velocity (fps) |
| Steel | | | | | | | | | | |
| Turnings | 432 | 51 | 2100 | 1.5 | 1000 | 0.0276 | 136 | 2500 | 0.0136 | 194 |
| Solid | 432 | 432 | 2100 | 1 | 1000 | 0.0276 | 324 | 2500 | 0.0136 | 461 |
| Magnesium | | | | | | | | | | |
| Turnings | 111 | 13 | 1000 | 1.5 | 250 | 0.0567 | 48 | 1300 | 0.0229 | 76 |
| Solid | 111 | 111 | 1000 | 2 | 250 | 0.0567 | 162 | 1300 | 0.0229 | 255 |
| Aluminum | | | | | | | | | | |
| Turnings | 169 | 20 | 1250 | 1.5 | 1000 | 0.0276 | 85 | 1600 | 0.0196 | 101 |
| Fragments | 169 | 169 | 1250 | 3 | 1000 | 0.0276 | 351 | 1600 | 0.0196 | 417 |
| UBC | 169 | 40 | 1250 | 1.5 | 1000 | 0.0276 | 121 | 1600 | 0.0196 | 143 |
| Glass | | | | | | | | | | |
| Batch | 143 | 143 | 3000 | 0.02 | 1000 | 0.0276 | 26 | 3500 | 0.0102 | 43 |
| Cullet | 156 | 156 | 3000 | 0.5 | 1000 | 0.0276 | 138 | 3500 | 0.0102 | 227 |
| Copper | | | | | | | | | | |
| Turnings | 558 | 66 | 1980 | 1.5 | 1000 | 0.0276 | 155 | 2250 | 0.0149 | 211 |
| Solid | 558 | 558 | 1980 | 1 | 1000 | 0.0276 | 368 | 2250 | 0.0149 | 502 |
| Lead | 708 | 708 | 620 | 1 | 400 | 0.0468 | 318 | 850 | 0.0307 | 393 |
| Titanium | 282 | 282 | 3000 | 1 | 1000 | 0.0276 | 262 | 3500 | 0.0102 | 431 |
| Zinc | 415 | 415 | 730 | 1 | 400 | 0.0468 | 244 | 1000 | 0.0276 | 318 |
| Hastalloy | | | | | | 0.0876 | | 1800 | 0.0178 | |
| Turnings | 577 | 68 | 2400 | 1.5 | 1000 | 0.0276 | 158 | 2800 | 0.0124 | 236 |
| Solid | 577 | 577 | 2400 | 1 | 1000 | 0.0276 | 375 | 2800 | 0.0124 | 560 |
| Tungsten | | | | | | | | | | |
| Turnings | 1,210 | 143 | 6170 | 1.5 | 1000 | 0.0276 | 228 | 6500 | 0.0058 | 499 |

EXAMPLE 2

The apparatus described in Example 1 was employed to decoat and preheat two types of scrap metal: 1) painted aluminum turnings, and 2) oily aluminum turnings. The scrap metal was heat treated at a rate of about 750 pounds per hour at a gas temperature from about 920° F. to 980° F. The heat treated material was tested for the presence of organic compounds. It was determined that all of the organic compounds were removed with no more than minimal oxidation of the metal.

EXAMPLE 3

The apparatus described in Example 1 was employed to decoat and melt coated aluminum used beverage cans and oily turnings. The melting was carried out in the same manner as Example 1 at a gas temperature in a range of about 1510° F. to 1660° F. The recovery of the heat treated metal exceeded 94%.

EXAMPLE 4

An apparatus of the present invention as shown in FIG. 1 is used to heat treat and melt shredded aluminum beverage cans having an effective density of about 40 (lbm/ft$^3$) and a throughput of about 5,000 pounds per hour. The gas temperature entering the lower opening of the chamber is about 1,800° F. and the gas temperature at the upper opening is about 1600° F. A suitable heating chamber has the following dimensions:

| | |
|---|---|
| Lower Opening Diameter: | 3 feet |
| Upper Opening Diameter: | 9 feet |
| Chamber Length: | 30 feet |

EXAMPLE 5

An apparatus of the present invention is used to preheat and decoat shredded aluminum beverage cans with an effective density of about 40 (lbm/ft$^3$) at the same throughput rate employed in Example 4. However, the gas temperature is set at about 1200° F. at the lower opening and 1000° F. at the upper opening for this operation. A suitable heating chamber has the following dimensions:

| | |
|---|---|
| Lower Opening Diameter: | 2.5 feet |
| Upper Opening Diameter: | 7 feet |
| Chamber length: | 25 feet |

Compared to the test described in Example 4, a lower gas temperature is required for preheating and decoating the shredded aluminum beverage cans. With a reduced thermal requirement, a chamber with reduced dimensions is selected to perform the operation of preheating and decoating.

EXAMPLE 6

An apparatus of the present invention is used to melt aluminum having an effective density of about 80 (lbm/ft$^3$) and a throughput of about 5,000 pounds per hour. The gas temperature entering the lower opening of the heating chamber is about 1,800° F. and the gas temperature at the upper opening is about 1600° F. A suitable heating chamber has the following dimensions:

| | |
|---|---|
| Lower Opening Diameter: | 2.5 feet |
| Upper Opening Diameter: | 8 feet |
| Chamber Length: | 23.5 feet |

A comparison of Examples 4 and 6 show that when the effective density of the heat treatable material doubles, a smaller chamber size may be employed to induce a higher gas velocity therethrough. With a higher gas velocity the gas flow is able to provide the lift necessary to suspend the denser material within the chamber.

EXAMPLE 7

An apparatus of the present invention is used to melt aluminum turnings having an effective density of about 20 (lbm/ft$^3$) and a throughput of about 5,000 pounds per hour. The gas temperature entering the lower opening of the heating chamber is about 1,800° F. and the gas temperature at the upper opening is about 1600° F. A suitable heating chamber has the following dimensions:

| | |
|---|---|
| Lower Opening Diameter: | 3.5 feet |
| Upper Opening Diameter: | 11 feet |
| Chamber Length: | 37 feet |

Comparing Examples 4 and 7, when the effective density is reduced by one-half, a larger chamber size may be employed to induce a lower gas velocity therethrough. A lower gas velocity is sufficient to provide the necessary force to suspend the heat treatable material because the density of the material has been reduced.

What is claimed is:

1. Apparatus for heat treating a heat treatable material, said apparatus comprising:

a) a housing comprising an upper opening for receiving a heat treatable material at a first temperature, a lower opening, and a chamber therebetween for heating the heat treatable material to a second temperature higher than the first temperature to thereby form a heated material, as the heat treatable material moves through the chamber from the upper opening to the lower opening;

b) a gas supply assembly operatively engaged to the housing at the lower opening, and comprising a source of heated gas, a gas delivery assembly for delivering the gas through a plurality of pathways into the housing in a manner providing countercurrent flow to movement of the heat treatable material at a flow velocity sufficient to suspend the heat treatable material for a time sufficient for the heated gas to heat the heat treatable material to form the heated material, whereby the heated material passes through the lower opening at said second temperature; and c) control means for controlling conditions within the chamber to enable the heat treatable material to reach the second temperature and form said heated material and pass through the lower opening at the second temperature.

2. The apparatus of claim 1 wherein the source of the gas comprises exhaust gas obtained from the chamber.

3. The apparatus of claim 1 wherein the source of gas comprises gas obtained from a source independent of the chamber.

4. The apparatus of claim 1 wherein the gas delivery assembly comprises an annular cavity having a plurality of openings in fluid communication with the lower opening in the housing and an entry port for receiving the gas, whereby the gas enters the annular cavity through the entry port, circulates therein and enters the housing through the plurality of openings of the annular cavity.

5. The apparatus of claim 4 further comprising a conduit extending from an upper portion of the housing to the entry port of the annular cavity wherein exhaust gas from the housing travels through the conduit into the gas delivery assembly for providing said gas to the housing.

6. The apparatus of claim 5 wherein the gas delivery assembly further comprises gas velocity control means.

7. The apparatus of claim 6 wherein the gas velocity control means comprises a blower.

8. The apparatus of claim 6 wherein said gas velocity control means comprises a vaporizable fluid feed assembly adapted for introducing a quantity of vaporizable fluid into the gas to generate a mass gas flow through the chamber.

9. The apparatus of claim 5 wherein the gas delivery assembly further comprises gas heating means.

10. The apparatus of claim 9 wherein the gas heating means further comprises a furnace.

11. The apparatus of claim 5 further comprising a heated material collecting assembly operatively engaged to the lower opening of said housing for receiving and collecting the heated material passing out of the chamber.

12. The apparatus of claim 11 wherein said heated material collecting assembly further comprises a holding furnace having a receptacle for retaining said heated material at said second temperature after passing out of the chamber.

13. The apparatus of claim 11 wherein said heated material collecting assembly further comprises a basin having a centrally located valve assembly for discharging said heated material.

14. The apparatus of claim 13 further comprising a post-heat treating apparatus for receiving the discharged heated material.

15. The apparatus of claim 14 wherein said post-heat treating apparatus is a melting furnace.

16. The apparatus of claim 13 wherein said valve assembly comprises a rotary air lock valve.

17. The apparatus of claim 1 wherein the cross-sectional area of the housing decreases from the upper opening to the lower opening.

18. The apparatus of claim 1 wherein the chamber has a chamber angle of about 0° up to an angle at which gas flow separation does not occur within the chamber.

19. The apparatus of claim 18 wherein the chamber angle is from about 0° to 10°.

20. The apparatus of claim 19 wherein the chamber angle is from about 3° to 7°.

21. The apparatus of claim 20 wherein the chamber angle is about 5.5°.

22. The apparatus of claim 1 wherein the control means comprises velocity control means for controlling the velocity of the gas as the gas moves through the chamber.

23. The apparatus of claim 22 wherein the velocity control means controls the velocity of the gas within the range of about 1 to about 900 feet per second.

24. The apparatus of claim 1 wherein the control means comprises temperature control means for controlling the temperature of the gas as the gas moves through the chamber.

25. The apparatus of claim 24 wherein the heat treatable material further comprises at least one vaporizable organic substance, said temperature control means controlling the temperature of the gas above the vaporization point of the organic substance.

26. The apparatus of claim 1 further comprising a heat treatable material feed assembly operatively connected to the upper opening of the housing for delivering the heat treatable material to the chamber through the upper opening.

27. The apparatus of claim 1 wherein the control means further comprises gas composition control means for controlling the composition of the gas within the chamber.

28. The apparatus of claim 27 wherein the heated gas contains oxygen in an amount of up to about 12% by volume.

29. The apparatus of claim 28 wherein the amount of oxygen content of the heated gas is within the range of from about 4% to 12% by volume.

30. The apparatus of claim 1 wherein the upper and lower openings, each independently have a diameter from about 1 feet to 15 feet.

31. The apparatus of claim 1 wherein the chamber has a length from about 5 feet to 60 feet.

32. The apparatus of claim 1 wherein the heat treatable material is selected from a group consisting of metal and glass.

33. The apparatus of claim 1 wherein the second temperature is above the melting point of the heat treatable material.

34. The apparatus of claim 1 wherein the second temperature is below the melting point of the heat treatable material.

35. The apparatus of claim 25 wherein the second temperature is above the vaporization point of the organic substance.

36. The apparatus of claim 1 wherein the housing further comprises a cleaning material delivery assembly for delivering a cleaning material onto an interior surface of the chamber.

37. The apparatus of claim 36 wherein said cleaning material delivery assembly comprises at least one injection mechanism disposed on the interior surface of the housing for injecting the cleaning material to the interior surface of the chamber.

38. The apparatus of claim 1 further comprising scraping means for scraping the interior surface of the chamber.

39. Apparatus for heat treating a heat treatable material, said apparatus comprising:

a housing having an upper opening for receiving a heat treatable material at a first temperature, a lower opening, and a chamber therebetween in which the heat treatable material is heated to a second temperature higher than the first temperature to thereby form a heated material as the heat treatable material moves from the upper opening to the lower opening;

a plenum connected to the lower opening of said housing, said plenum having a vertical throughhole in communication with the lower opening of said chamber, an interior annular cavity extending around said throughhole, an inlet port in communication with said annular cavity and a plurality of spaced apart channels arranged radially around said throughhole and fluidly connecting said throughhole with said annular cavity; and a gas supply assembly operatively connected to the input port of said plenum, for generating a heated gas flow through the plenum and upwardly through said chamber from the lower opening to the upper opening, said heated gas flow having a temperature sufficient to heat the heat treatable material within the chamber to said second temperature, and a sufficient flow velocity for selectively sustaining the heat treatable material afloat in the chamber until the heat treatable material reaches the second temperature, and forms the heated material which passes through the lower opening and the throughhole of said plenum.

40. The apparatus of claim 39 further comprising a feed assembly located proximate to the upper opening for delivering the heat treatable material through the upper opening into said chamber.

41. The apparatus of claim 40 further comprising heated material receiving means for receiving the heated material exiting from the lower opening of said chamber through the throughhole of said plenum.

42. The apparatus of claim 39 further comprising a closed loop circulation duct for recycling gas from the upper opening to the gas supply assembly.

43. The apparatus of claim 42 wherein said gas supply assembly further comprises a blower for aiding the gas flow through said chamber.

44. The apparatus of claim 39 wherein the chamber comprises a non-uniform cross section where the velocity of the gas flow in said chamber is sufficient to suspend the heat treatable material in the chamber at least substantially uniform for a sufficient time to heat the heat treatable material to the second temperature and thereby form the heated material.

45. The apparatus of claim 39 further comprising a heating means for supplying heat forming the heated gas flow and maintaining the heated gas at a temperature sufficient to heat the heat treatable material to the second temperature.

46. A method for heat treating a heat treatable material, said method comprising the steps of:

a) passing the heat treatable material through a housing from an upper opening at a first temperature through a chamber to form a heated material and passing the heated material out of a lower opening;

b) passing a heated gas through a plurality of pathways into the chamber to generate a flow of the heated gas countercurrent to the direction of the heat treatable material as it passes from the upper opening to the lower opening to thereby form the heated material in a manner such that the heated material leaves the lower opening at a second temperature higher than the first temperature;

c) establishing a flow velocity of the heated gas sufficient to suspend discrete portions of the heat treatable material for a sufficient time for the heated gas to heat the heat treatable material and form the heated material at the second temperature; and d) controlling the conditions within the chamber to enable the heat treatable material to attain the second temperature.

47. The method of claim 46 wherein the heat treatable material is selected from a group consisting of metals and glass.

48. The method of claim 46 wherein the second temperature is above the melting point of the heat treatable material.

49. The method of claim 46 wherein the second temperature is below the melting point of the heat treatable material.

50. The method of claim 49 further comprising the steps of:

terminating the flow of the heated gas when the heat treatable material reaches the second temperature; and repeating the steps (a) and (b).

51. The method of claim 49 further including the steps of:

introducing a first heat treatable material into said chamber;

terminating the flow of said heated gas for a time sufficient to allow all of said first heat treatable material to pass out of said chamber as a heated material;

resuming the flow of said heated gas; and introducing a second heat treatable material into said chamber.

52. The method of claim 49 wherein the heat treatable material further comprises at least one organic substance, said method comprising heating the heat treatable material to the second temperature above the vaporization point of said organic substance.

53. The method of claim 46 further comprising adding a flux composition into said chamber as said heat treatable material passes into said chamber.

54. The method of claim 46 further comprising restricting the amount of oxygen in the heated gas to an amount of up to about 12% by volume.

55. The method of claim 46 wherein the amount of oxygen in the heated gas is in a range of from about 4 to 12%.

56. The method of claim 46 comprising heating the heated gas with a furnace.

57. The method of claim 46 wherein the flow velocity of the heated gas is in the range of about 1 to 900 feet per second.

58. The method of claim 46 comprising receiving and collecting the heated material exiting the chamber.

59. The method of claim 46 further comprising the step of recirculating at least a portion of the heated gas passing through the chamber from the upper to the lower openings.

60. The method of claim 46 wherein said heated gas is a waste exhaust gas from an independent source.

61. The method of claim 46 further comprises the step of injecting a cleaning material into the chamber to clean an interior surface of the chamber.

* * * * *